United States Patent [19]

Schmidt, Jr. et al.

[11] 4,131,869

[45] Dec. 26, 1978

[54] PLUG-IN FUSE ASSEMBLY CONSTRUCTION

[75] Inventors: John Schmidt, Jr., Mount Prospect; Avinash Aryamane, Elk Grove, both of Ill.

[73] Assignee: Littelfuse, Inc., Des Plaines, Ill.

[21] Appl. No.: 790,665

[22] Filed: Apr. 25, 1977

Related U.S. Application Data

[63] Continuation-in-part of Ser. No. 698,079, Jun. 21, 1976, Pat. No. 4,023,264.

[51] Int. Cl.[2] ..... H01H 85/22

[52] U.S. Cl. ..... 337/264; 337/295

[58] Field of Search ..... 337/198, 201, 206, 262, 337/263, 264, 293, 295

[56] References Cited

U.S. PATENT DOCUMENTS

| | | | |
|---|---|---|---|
| 3,717,836 | 2/1973 | Humphreys | 337/264 |
| 3,775,724 | 11/1973 | Mainrick et al. | 337/264 X |

*Primary Examiner*—George Harris

*Attorney, Agent, or Firm*—Wallenstein, Spangenberg, Hattis & Strampel

[57] ABSTRACT

A plug-in fuse element comprises a one-piece plate-like body of fuse metal which forms parallel terminal blade portions having current-carrying extensions connected by a fuse link portion. For high current rated fuses, the fuse link portion extends between the current-carrying extensions at points much closer to the terminal blade portions than to the outer ends of the current-carrying extensions. An insulating body, preferably forming a housing, is rigidly anchored between the current-carrying extensions. The insulating body is preferably staked to the current-carrying extensions of the plug-in fuse element, there being anchoring apertures provided in the current-carrying extensions for the staking projections produced thereby. The anchoring apertures are located in the current-carrying extensions beyond the point where the fuse link portion joins the current-carrying extensions. For the lowest current rated fuses, the fuse link is provided with a repeatedly undulating configuration and joins the current-carrying extensions as far away as practical from the terminal blade ends of the current-carrying extensions.

17 Claims, 16 Drawing Figures

FIG. 5
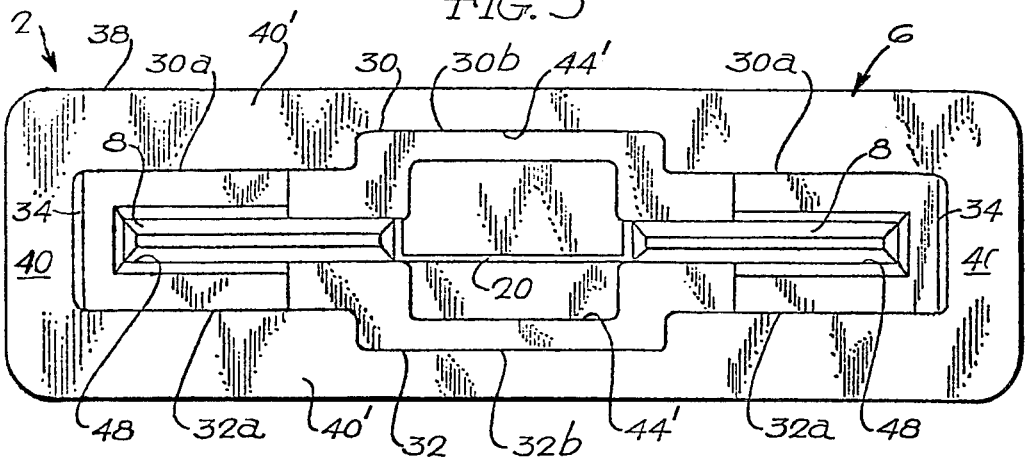
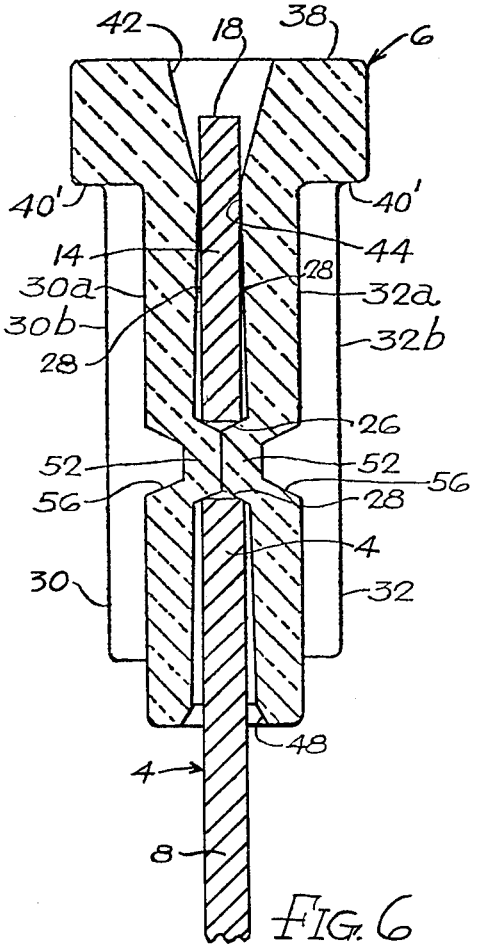
FIG. 6
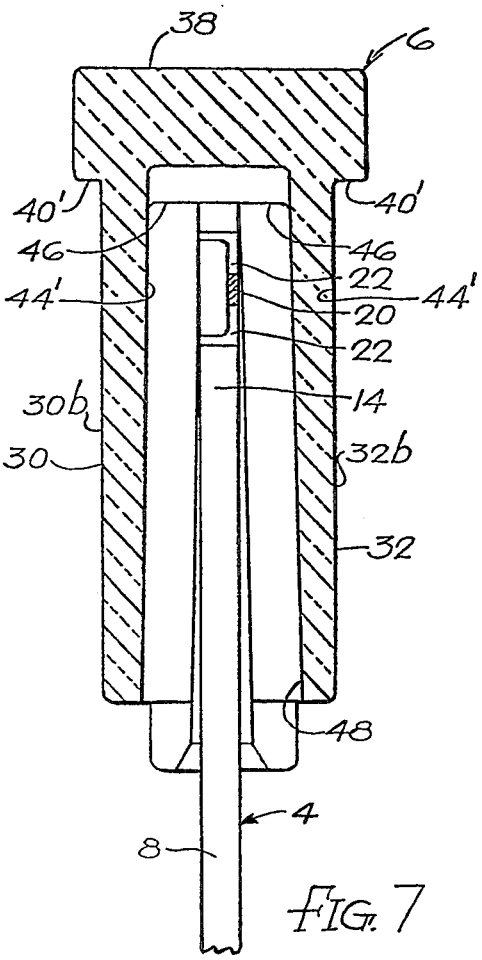
FIG. 7

DIMENSIONS COMMON TO ALL DESIGNS

DESIGN I
30 AND 25 AMPS.

DESIGN II
20 AND 15 AMPS.

DESIGN III
10 AMPS.

DESIGN IV
7½ AND 5 AMPS.

PLUG-IN FUSE ASSEMBLY CONSTRUCTION

RELATED APPLICATION

This application is a continuation-in-part of application Ser. No. 698,079, filed June 21, 1976 now U.S. Pat. No. 4,023,264, granted May 17, 1977.

BACKGROUND AND SUMMARY OF THE INVENTION

Briefly, this invention has to do with an improvement in the plug-in fuse assembly disclosed in U.S. Pat. No. 3,909,767, granted Sept. 30, 1975, and which preferably comprises a plug-in element including a plate-like body of fuse metal having a pair of spaced confronting terminal blade portions to be received by pressure clip terminals in a mounting panel, current-carrying extensions at the inner end portions of the pair of terminal blade portions and a fuse link portion of reduced thickness interconnecting the current-carrying extensions. An insulating body, preferably forming a synthetic plastic housing, is anchored between the current-carrying extensions, with the pair of terminal blade portions thereof extending outwardly from the housing. One of the cost saving and size reducing aspects of the plug-in fuse assembly just described is that each plug-in fuse element can be a stamping made from a blank or strip of fuse metal, and a completely housed fuse results from merely enclosing the same in an insulating housing, so that the entire fuse assembly is formed of only two parts, and without any soldering operations required to connect a fuse link between the terminal portion of the fuse. For electrical testing purposes, the outer wall of the hosuing facing away from the side of the housing from which the terminal blade portions extend may be provided with probe-receiving apertures into or adjacent to which the outer end portions of the current-carrying extensions extend. These apertures receive test probes for testing the resistance or continuity of the fuse link portion of the plug-in fuse element. The fuse link portion of the plug-in fuse element is shown as a straight link positioned in spaced but contiguous relation to this outer wall of the housing which was transparent, so that the fuse link portion could be readily viewed through this outer wall when a number of plug-in fuse assemblies are mounted in close juxtaposed relation in a mounting panel where the sides of the housing are not readily visible. The housing is shown formed to receive the current-carrying extensions of the plug-in fuse element in relatively closely spaced relation. The housing walls are preferably staked into anchoring apertures in the current-carrying extensions of the plug-in fuse element to anchor the same thereto.

The above-described plug-in fuse assembly disclosed in this patent, while satisfactory for intermediate current ratings, causes problems at low or high current ratings. The high current fuse problem is that the plastic housing sometimes melted before the fuse blew. It was discovered that this resulted, in part, from the fact that the anchoring apertures were positioned centrally in the current-carrying extensions where they are located between the point of intersection of the fuse link portion of the plug-in fuse element and the terminal blades, so that current flowing between the fuse link and the terminal blades must pass through a portion of the current-carrying extensions reduced in cross-sectional area by the anchoring apertures. The temperature of this section of the plug-in fuse element next to the housing can be appreciable at high current flow because the resistance to current flow is inversely proportional to the cross-sectional area of the current path and the heat developed in a resistance is proportional to the square of the current flow. There is, therefore, a danger that a housing made of a plastic material will be damaged at the point where the anchoring apertures are located.

In accordance with one of the features of the invention, for a relatively high fuse rating (for example of 25 and 30 amp fuses), the fuse link is located on the terminal blade side of the anchoring apertures so load current does not flow through the reduced portion of the current-carrying extensions. Also, heat dissipation is increased by preferably locating the point where the fuse link joins the current-carrying extensions close to the terminal blade end of the current-carrying extensions so that the heat sink effect of the pressure clip terminals is increased by bringing the medium current path point closer thereto and the total path resistance for current flow is decreased.

Another difficulty with the plug-in fuse assembly design shown in said patent is that a low current ratings using the straight fuse link, the fuse link sometimes collapsed before the current reached a level where it was supposed to melt or soften appreciably. To obtain the high resistance necessary to generate the heat necessary to melt the fuse link at rated current, with a short straight fuse link the cross-sectional area thereof was reduced to such a small value that while the fuse link was self-supporting at normal low current levels, currents approaching the fuse rating will weaken the fuse link to a point of collapse even though the fuse link did not yet melt or soften appreciably.

In accordance with another feature of the invention, instead of providing a fuse link which is formed by a straight section of fuse metal when the fuse link must have such a cross-sectional area that it collapses when the temperature thereof approaches but does not reach the melting point of the fuse, a more substantial safe cross-sectional area is utilized and the necessary resistance is provided at the lowest current ratings by a repeatedly undulating fuse link configuration to provide a relatively large resistance for a given limited spacing between the current-carrying extensions provided for the fuse link. The major portion of the length of such an undulating configuration extends generally parallel to the length of the current-carrying extensions. Also, to minimize the heat sinking effect of the pressure clip terminals which receive the terminal blade portions of the plug-in fuse element, at least one end of the fuse link makes contact with a current-carrying extension at the end thereof most remote from the end adjacent to the terminal blade portions thereof, where the heat sink effect of the fuse support is minimized.

Further objects of this invention reside in the particular method steps and in the cooperative relationships between the method steps in making the aforementioned plug-in fuse assembly.

The previously described and other features of this invention will become apparent to those skilled in the art upon reference to the accompanying specification, claims and drawings.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

DESCRIPTION OF THE PREFERRED EMBODIMENT OF THE INVENTION

Referring now more particularly to FIGS. 1–4, there is shown a plug-in fuse assemby 2 made of only two component parts, namely a plug-in fuse element 4 which most advantageously is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking an ultrasonic welding operation.

Figure 1:
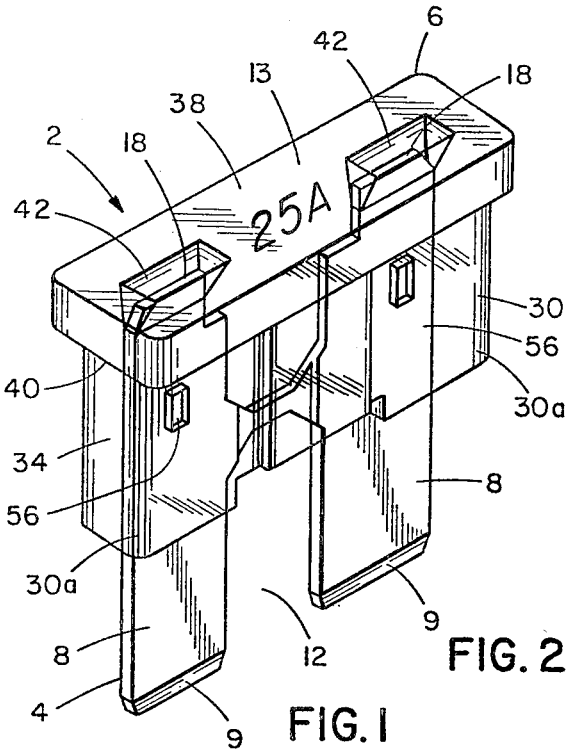
FIG. 1 is a perspective view of a preferred form of the plug-in fuse assembly of the invention.
Figure 2:
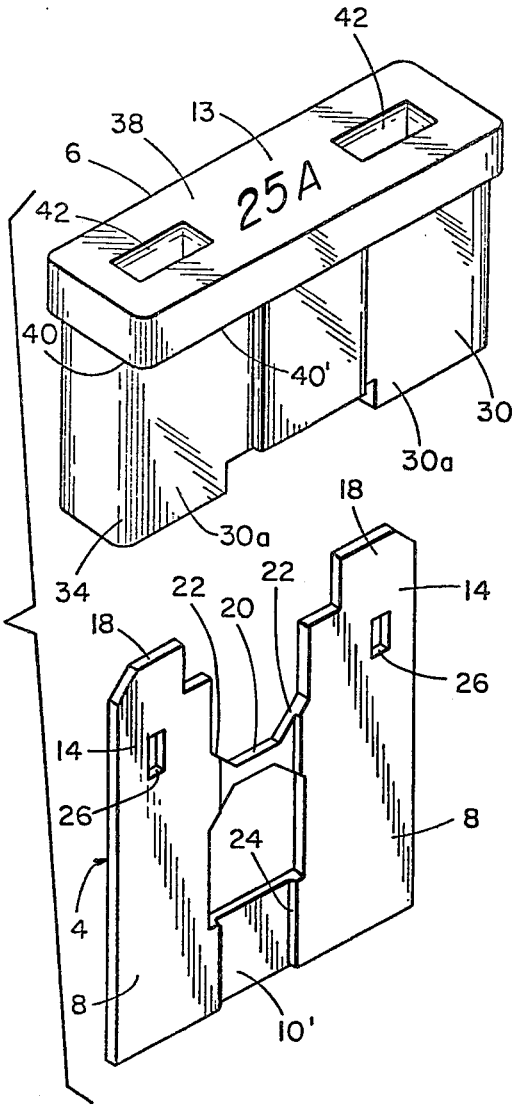
FIG. 2 is an exploded view of the housing and plug-in fuse element for making up the plug-in fuse assembly of FIG. 1.
Figure 3:
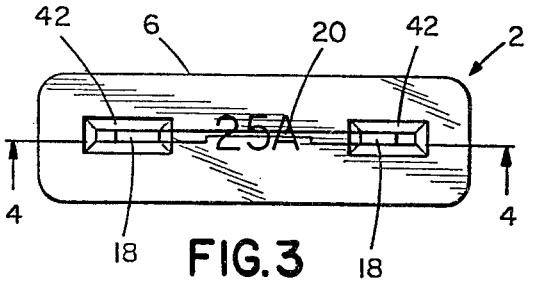
FIG.3 is a top plan view of the plug-in fuse assembly of FIG. 1.
Figure 4:
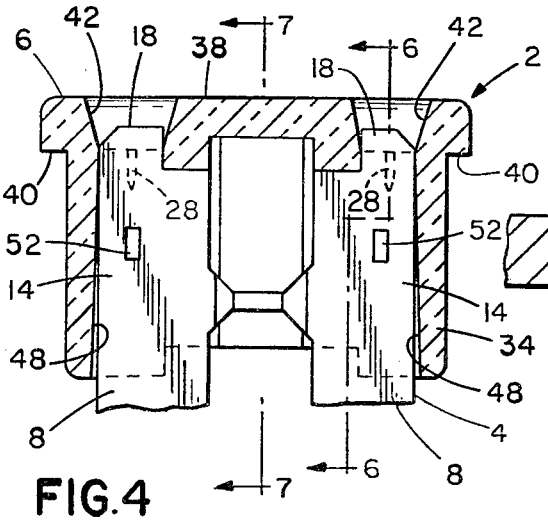
FIG. 4 is a vertical longitudinal sectional view through the plug-in fuse assembly shown in FIG. 3, taken along section line 4—4 therein.

The plug-in fuse element 4 has terminal blade portions 8—8 plated with a highly conductive metal like tin extending in spaced parallel relationship from the inner or bottom margin of the housing 6 in what will be referred to as a downward or inwardly extending direction. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel sockets. The current rating of the plug-in fuse assembly is indicated by indicia 13 on the outer wall of the housing as shown in FIGS. 1–2 and/or by a distinctive housing color.

Figure 15:
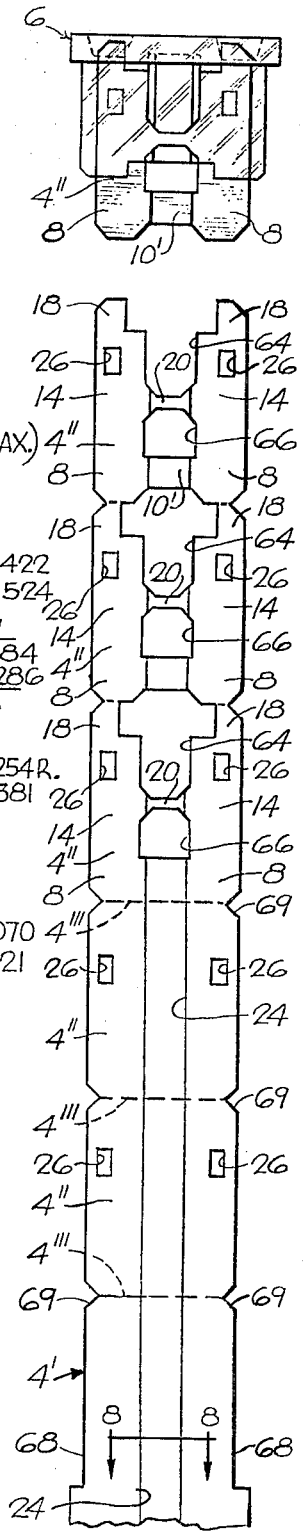
FIG. 15 is an elevational view diagrammatically illustrating a method of blanking the strip of fuse metal to provide a plug-in fuse element of design I and the application of the housing thereto to provide a plug-in fuse assembly having a fuse rating of 30 to 25 ampere.

The plug-in fuse element 4 may be formed from a partially tin plated strip 4′ of fuse metal (FIG. 15). Prior to the plug-in fuse element being severed from the strip 4′, the terminal blade portions 8—8 may be interconnected to form a transverse rigidifying web 10′ stamped from a reduced portion of the strip. The stamping operation also forms the terminal blade portions 8—8 defined by a gap 12 between the same. The tapered portions 9—9 of the terminal blade portions 8—8 may be formed by coining dies (not shown) preferably after the operation which severs the plug-in fuse element from the strip.

The terminal blade portions 8—8 have current-carrying extensions 14—14 which are preferably tin plated at least at the outer end portions thereof where, continuity checking probe-receiving tabs 18—18 are formed. The current-carrying extensions project into the aforementioned space formed by the housing 6 where they are contiguous to the front or outer wall of the housing to be described. The current-carrying extensions 14—14 are interconnected by an unplated fuse link portion 20 which is preferably both narrower in width and much smaller in thickness than the other current-carrying portions of the plug-in fuse element 4. (However, especially large current rated fuses could have the same thickness as the other portion of the plug-in fuse element.) The current-carrying capacity of the fuse link portion 20 is varied by varying its location and/or its configuration including its width and length dimensions. In the particular configurations of the plug-in fuse element 4 shown in FIGS. 2 and 4 the current-carrying extensions 14—14 join the fuse-forming link portion 20 of the plug-in fuse element 4 by tapered portions 22—22. All of the various parts of the plug-in element are shown substantially in co-planar relation.

Figure 8:
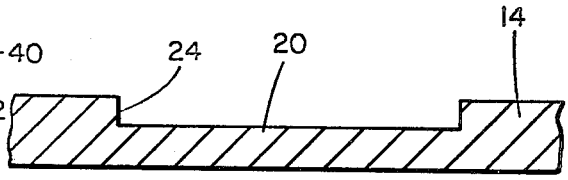
FIG. 8 is an enlarged fragmentary sectional view through the fuse link portion of the plug-in fuse assembly shown in FIG. 2, taken substantially along section line 8—8 of FIGS. 2 and 15 and 16, and showing the preferred manner in which the fuse-forming link portion thereof is reduced in thickness.
Figure 16:
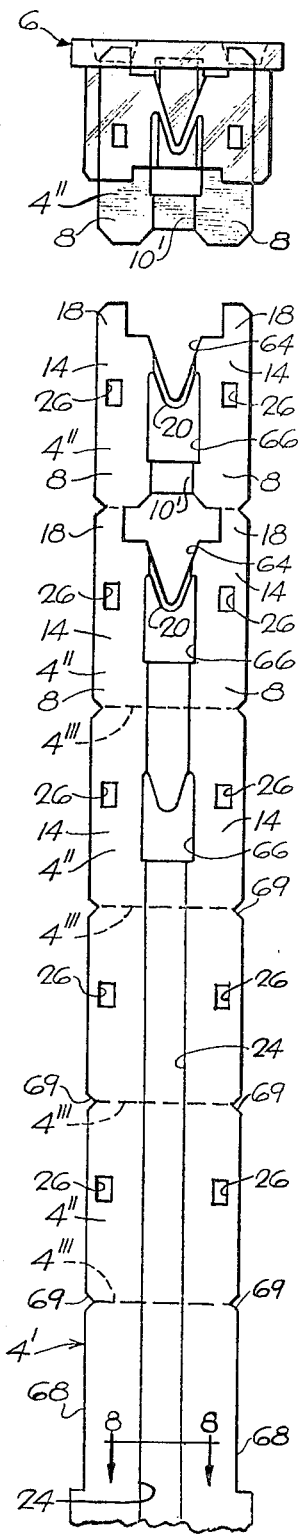
FIG. 16 is an elevational view diagrammatically illustrating a method of blanking the strip of fuse metal to provide a plug-in fuse element of design III and the application of the housing thereto to provide a plug-in fuse assembly having a fuse rating of 10 ampere.

If a reduced thickness of the fuse metal of the fuse-forming link portion 20 is needed, it is preferably achieved by initially providing the strip 4′ of fuse metal and, hence, the blanks 4″ of the strip with a groove 24 extending longitudinally throughout the strip 4′, as shown in FIGS. 8, 15 and 16, to provide a longitudinally extending portion of reduced thickness in the strip 4′ and the blanks 4″ located at one face of the strip as in FIG. 8. The groove 24 is preferably formed in the strip 4′ by initially milling and scarfing the strip under close control of tolerances in conventional fashion to provide a portion of reduced thickness in the strip of fuse metal which is maintained within close tolerances.

Different desired fuse ratings of the plug-in fuse assembly are determined by the composition of the fuse metal in the strip 4 of fuse metal, the thickness dimension of the fuse link portion 20, the location of the fuse forming link portion 20, and the configuration of the fuse link portion 20 including width and length dimensions. Here, the composition of the fuse metal and the thickness dimension of the fuse link portion 20 are fixed parameters since the plug-in fuse elements having different fuse ratings are all fabricated from a common strip or blank of fuse metal having a continuous portion of reduced thickness of fixed thickness dimension. The different desired fuse ratings are here obtained by selectively arranging the fuse-forming link portions 20 of fixed reduced thickness dimensions in desired locations and by selectively providing the fuse link portion 20 with desired configurations including width and length dimensions. Typical examples of plug-in fuse elements 4 to provide the plug-in fuse assemblies having a wide range ampere fuse ratings (including ratings of 30, 25, 20, 15, 10 7½ and 5 amperes) are illustrated in FIGS. 9 to 14 and described below, the various dimensions being in millimeters and the scale of the figures being approximately 4:1.

Figure 9:
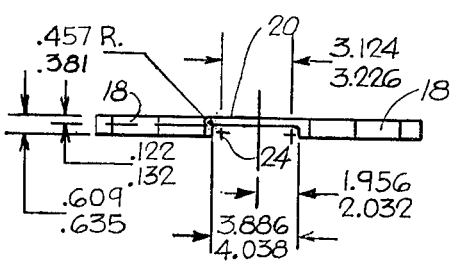
FIG. 9 is a top view of the plug-in fuse elements illustrated in FIGS. 2 and 11 to 14 setting forth typical dimensions which are common to the various different plug-in fuse elements having different fuse ratings.
Figure 10:
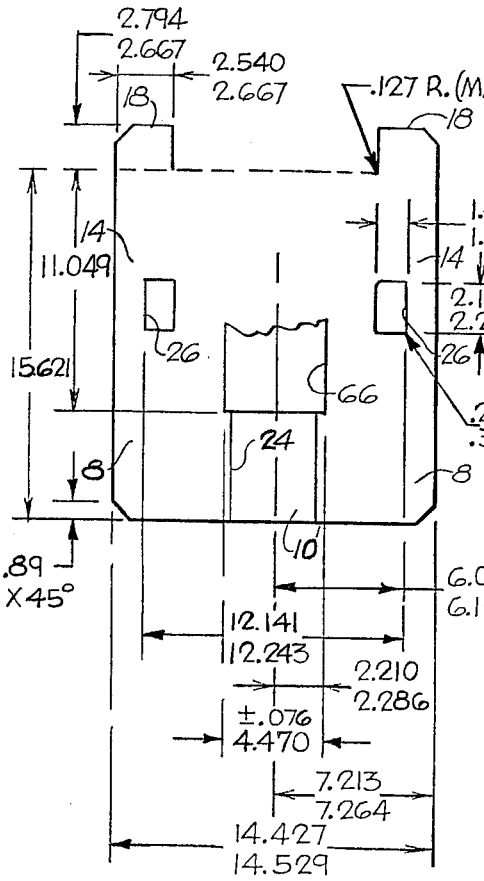
FIG. 10 is an elevational view of the plug-in fuse elements illustrated in FIGS. 2 and 11 to 14 setting forth typical dimensions which are common to the various different plug-in fuse elements having different fuse ratings.

The fuse metal strip 4' and the blanks 4'' formed therefrom may have the following composition in weight percent, Fe 0.08 max., Cd 0.07 max., Cu 0.75–1.25, Pb 0.10 max., Mg 0.01 max. and Zn balance. The strip of fuse metal as shown in FIG. 9 has a thickness of 0.609/0.635 and a continuous central portion of reduced thickness, formed by a groove 24 on one side of the strip, having a fixed thickness dimension of 0.122/0.132 and a groove width of 3.886/4.038. These are parameters which are fixed regardless of the desired fuse ratings for the plug-in fuse assemblies. There are also further fixed dimensions which are also present in the plug-in fuse elements regardless of the fuse ratings thereof, as set forth in FIG. 10, including the length and the width dimensions of the plug-in fuse element, the dimensions of the extensions 18, the dimensions of the apertures 26, and the width dimension and the length limiting dimension of the blanked portion 66 of the element.

Figure 11:
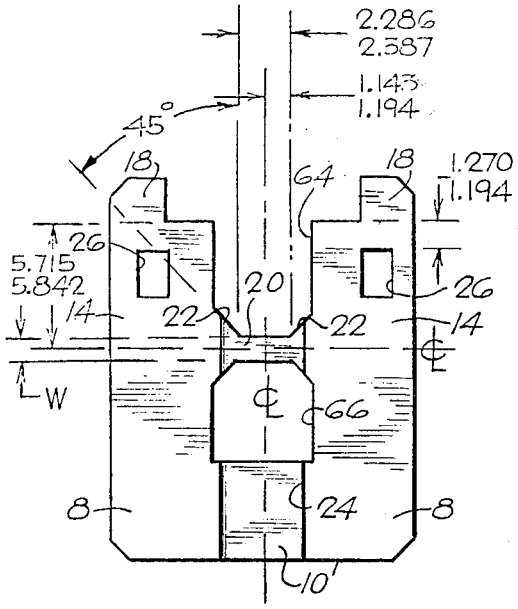
FIG. 11 is an elevational view of design I of the plug-in fuse element setting forth additional typical dimensions for providing 30 and 25 ampere fuse ratings for the plug-in fuse assembly.

FIG. 11 illustrates Design I of the plug-in fuse element for providing fuse ratings of 30 and 25 amperes. It sets forth dimensions for the locations of the openings 26 and of the fuse link portion 20, it being noted that the centerline of the fuse link portion 20 is located a substantial distance (5.713/5.842) from the upper edge of the coplanar current-carrying extensions 14 while the openings 26 are located a relatively short distance (1.270/1.397) therefrom. The "blowing" of the fuse-forming link portion 20 is dependent upon the temperature thereof which in turn is dependent upon the current flowing therethrough which heats the same and upon the rate of dissipation of heat therefrom. In this Design I of FIG. 11, the fuse link portion 20 is interconnected between the current-carrying extensions 14 near the terminal blade portions 8 so that heat may be readily dissipated from the fuse link portion 20 to the terminal blade portions 8 and the pressure clip terminals (not shown) receiving such terminals. This heat dissipation effect is maximized by the location of the fuse link portion on the terminal blade side of the openings 26—26, its closeness to the terminal blades, and the large cross-sectional area of the current-carrying extensions leading to the terminal blade portions (since such cross-sectional area in such heat dissipation path is not decreased by the openings 26—26 which are outside of such heat dissipation path). As a result, Design I of FIG. 11 can conduct relatively high currents before "blowing" and provides a plug-in fuse assembly of relatively high ampere rating, such as 30 and 25 amperes.

In this Design I of FIG. 11, the effective length of the fuse-forming link portion 20 is 2.286/2.387 and for a 30 ampere fuse rating the width dimension W is 1.143 ± 0.025, while for a 25 ampere fuse rating the width dimension W is 0.889/0.927. The smaller width dimension W for the 25 ampere fuse rating causes the fuse link portion 20 to heat up to a greater temperature for a given current passing therethrough than for the larger width dimension W for the 30 ampere fuse rating with the result that the former will "blow" at 25 amperes and the latter will "blow" at 30 amperes.

Figure 12:
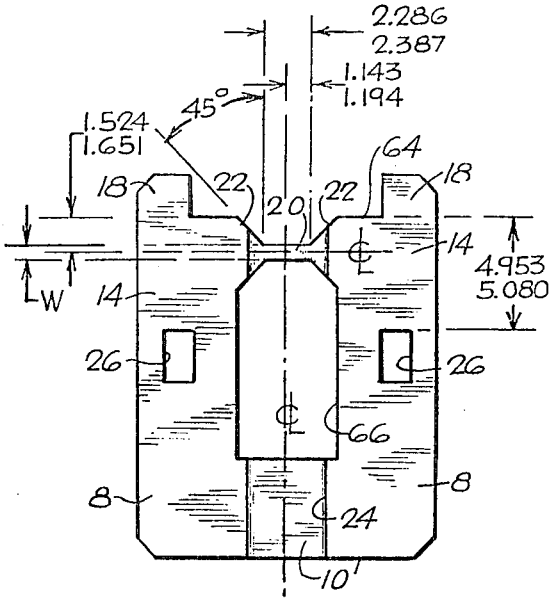
FIG. 12 is an elevational view of design II of the plug-in fuse element setting forth additional typical dimensions for providing 20 and 15 ampere fuse ratings for the plug-in fuse assembly.

FIG. 12 illustrates Design II of the plug-in fuse element for providing fuse ratings of 20 and 15 amperes. It sets forth dimensions for the locations of the openings 26 and of the fuse link portions 20, it being noted that the centerline of the fuse-forming link portion 20 is located a relatively short distance (1.524/1.651) from the upper edge of the coplanar current-carrying extensions 14 while the openings 26 are located a substantial distance (4.953/5.080) therefrom. Here, as in Design I and the other Designs of this invention, the blowing of the fuse link portion is dependent upon the temperature thereof which in turn is dependent upon the current flowing therethrough which heats the same and upon the rate of heat dissipation therefrom. In the Design II of FIG. 12, the fuse link portion 20 is interconnected between the current-carrying extensions 14 near the upper edges of the extensions 14 and remote from the terminal blade portions 8 so that heat is not dissipated away from the fuse link portion to the terminal blade portions 8 and the pressure clip terminals (not shown) receiving such terminals as rapidly as in Design I of FIG. 11. This heat dissipation effect is also minimized by the decrease in cross-sectional area in such heat dissipation path occasioned by the openings 26 in such path. As a result, Design II of FIG. 12 will not conduct as much current before "blowing" as in the case of Design I of FIG. 11 and therefore provides a plug-in fuse assembly having a lower fuse rating, such as 20 and 15 amperes.

In this Design II of FIG. 12, the effective length of the fuse link portion 20 is 2.286/2.387, the same as in Design I of FIG. 11. For a 20 ampere fuse rating the width dimension W is 0.648/0.674 while for a 15 ampere fuse rating the width dimension W is 0.414/0.440. The smaller width dimension W for the 15 ampere fuse rating causes the fuse link portion 20 to heat up to a greater temperature for a given current passing therethrough than for the larger width dimension W for the 20 ampere fuse rating with the result that the former will "blow" at 15 amperes and the latter will "blow" at 20 amperes.

Figure 13:
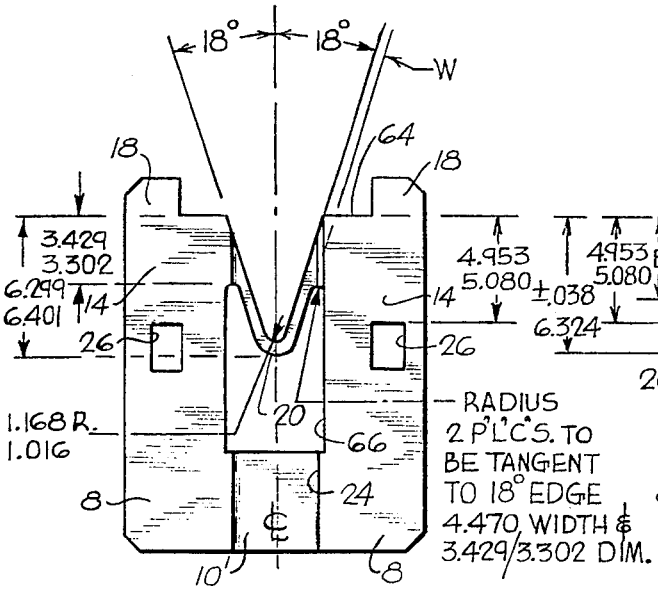
FIG. 13 is an elevational view of design III of the plug-in fuse element setting forth additional typical dimensions for providing 10 ampere fuse ratings for the plug-in fuse assembly.

FIG. 13 illustrates Design III of the plug-in fuse element for providing a fuse rating of 10 amperes. It sets forth dimensions for the locations of the openings 26 which are the same as for Design II and for the location and configuration of the fuse link portion 20. The fuse link portion 20 is located a short distance from the upper edge of the current-carrying extensions 14 and remote from the terminal blade portions 8 and interconnects with the current-carrying extensions above the openings 26, also, as in Design II, with similar heat dissipation characteristics. The fuse link portion 20 has a substantially V-shaped configuration to provide a longer fuse link portion than in Design II. In this connection, the bottom edge of the upper portions of the fuse link portion 20 is located 3.429/3.302 from the upper edge of the current-carrying extensions and the bottom edge of the central portion 6.299/6.401 therefrom.

The two legs of the V-shaped fuse link portion 20 of Design III of FIG. 13 are each arranged at 18° from the vertical and merge in a radius of 1.168/1.016 and the width W of the fuse link portion 20 is 0.521/0.559. Where the bottom edge of the fuse link portion 20 interconnects with the current-carrying extensions 14, it is provided with radii of 0.305/0.203 which are tangent to the 18° edge, the 4.470 width edges of the blanked portion 66 and the 3.429/3.302 dimension. The fuse link portion 20 of FIG. 13 having this location and this configuration including the length and width dimensions provides the plug-in fuse assembly with a fuse rating of 10 amperes.

Figure 14:
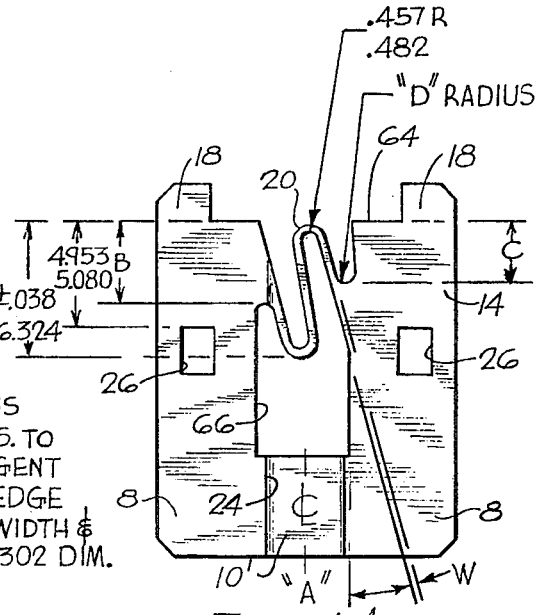
FIG. 14 is an elevational view of design IV of the plug-in fuse element setting forth additional typical dimensions for providing 7½ and 5 ampere fuse ratings for the plug-in fuse assembly.

FIG. 14 illustrates Design IV, the low current rated fuse design of the invention, which has been used for fuse ratings of 7½ and 5 amperes. It sets forth dimensions for the locations of the openings 26—26 which are the same as for Designs II and III and for the locations and configurations of the fuse link portion 20. Here, also, the fuse link portion 20 is located a short distance from the upper edge of the current-carrying extensions 14 and remote from the terminal blade portions 8 and interconnects with the current-carrying extensions above the openings 26, and has minimum heat dissipation characteristics similar to those of Designs II and III because the fuse link portion connects with the current-carrying extensions at points relatively remote from the heat sinks provided by the points where the terminal blades engage the pressure clip terminals and at points beyond the openings 26—26. The fuse link portion 20 of FIG. 14 has a substationally S-shaped configuration to provide a still longer fuse-forming link portion than in Designs II and III. In this connection, the bottom edge of the fuse link portion 20 is located 6.324 ± 0.038 from the upper edge of the current-carrying extensions and the top edge thereof is located even with the upper edge of the extensions 14.

In Design IV of FIG. 14, the central portion of the substantially S-shaped fuse link portion 20 is connected by radii of 0.457/0.482 to the end portions thereof and the end portions are also interconnected by radii D to the current-carrying extensions 14 at distances B and C. The end portions of the fuse link portion 20 are arranged at an angle A and the fuse link portion 20 has a width W. For a 7½ ampere fuse rating, angle A is 13°, distance B is 4.124, distance C is 2.210 radius D is 0.406/0.432 and width W is 0.609/0.635. On the other hand, for a 5 ampere fuse rating, angle A is 15°30′, distance B is 3.362, distance C is 2.692, radius D is 0.457/0.482 and width W is 0.406/0.432. The fuse link portion 20 for the 5 ampere fuse rating is longer and has less width than that of the 7½ ampere fuse rating.

The foregoing sets forth, by way of specific example, how different desired fuse ratings may be obtained with plug-in fuse elements having many common dimensions including fuse link portions 20 of fixed thickness dimension by selectively arranging the fuse link portions in desired locations and by selectively providing the fuse link portions 20 with desired configurations including width and length dimensions.

While the plug-in fuse element 4 may be used as a fuse element without its incorporation in the housing 6, for safety reasons and for current ratings where the fuse link portion thereof is fragile it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse link portion 20 of the plug-in fuse element 4. Also, to anchor the plug-in fuse element 4 within the housing 6, anchoring openings 26—26 are formed in the terminal extensions 14—14 to receive anchoring projections to be described formed in the housing walls.

While the housing 6 could be made in two separate parts snappable together, the housing is most advantageously a single piece molded part as previously indicated. Also, it preferably has a narrow elongated configuration formed by relatively closely spaced side walls generally indicated by reference numeral 30–32, the side walls having end portions **30*a*–32*a* and 30*a*–32*a* which are spaced together much more closely than the central or intermediate portions 30*b*–32*b* thereof. The side walls 30–32 are interconnected at their end margins by narrow end walls 34—34, and at their user or top margins by an outer wall 38 which overhangs the rest of the housing to form downwardly facing shoulders 40—40 at the longitudinal ends of the outer wall 38 and downwardly facing shoulders 40′—40′ along the longitudinal side margins of the housing 6. The shoulders 40′—40′ are coplanar continuations of the shoulders 40—40 at the ends of the housing 6**.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access openings 42—42 ae relatively small because of the close spacing of the side wall portions **30*a*–32*a* of the housing at these points, the width of the space portions 44—44 as viewed in FIG. 6 tapering from the bottom open end of the housing upwardly toward the terminal access openings 42—42, reaching a narrow dimension about equal to the thickness of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal blade portions 8—8** of the plug-in fuse element.

The fuse link portion 20 of the fuse element 4 is positioned in a relatively wide portion 44′ (FIG. 7) of the housing interior, to provide for free circulation of air around the center portion of the fuse link portion, which is the part thereof which first melts under excessive current flow, so heat does not accumulate which would adversely effect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion or end blank of the pre-stamped and milled strip 4' from which a completed fuse element is punched and immediately following the housing 6 is secured to the end portion or end blank of the strip as previously indicated.

The housing 6 is preferably a molded part made of a transparent synthetic plastic material so that the fuse filament portion 20 of the plug-in fuse element 4 is visible in varying degrees through the intermediate portion of the outer wall 38 depending upon the closeness of the fuse to the wall. The housing is preferably molded of a high temperature transparent Nylon made by Union Carbide under the trademark "POLYSULFONE" and order No. P1700, Natural 11. However, such a material has a melting temperature of about 176° C./264 psi greatly below the melting temperature of the fuse metal which would generally be in excess of 419° C.

While the housing interior 6 could be made with resilient projections which snap into the anchoring apertures or openings 26—26 in the plug-in fuse element 4, it is preferred to secure the housing in place by forming projections 52 from both sides of the housing 6 by a cold staking operation, which enter the anchoring apertures 26—26 of the plug-in fuse element 4. The inwardly extending projections 52 formed by the cold staking operation where they engage each other in the anchoring apertures or openings 26 are preferably welded together by ultrasonic welding or the like to provide a rigid anchoring structure. The depressions 56 left by the staking operation are shown in the side wall 30 in FIGS. 1 and 6.

The exemplary embodiments of the invention just described have thus povided an exceedingly reliable, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse link portion of the plug-in fuse element can be viewed when the plug-in fuse assembly is mounted on the mounting panel. The terminal access openings enable test equipment to test the continuity of the fuse if the user does not desire to rely solely on a visual observation of the fuse link portion of the fuse.

The preferred method of making the plug-in fuse assemblies is illustrated in FIGS. 15–16. Before the strip 4' is grooved, it preferably is a fuse metal body of the same thickness throughout. The fuse metal strip may be initially plated throughout with a conductive coating which does not oxidize in the surrounding air. Where tin is selected as this conductive coating, to prevent bleeding of the fuse metal through the tin coating an initial coating of copper is most advantageously plated on all exposed surfaces of the ungrooved strip following which tin is similarly plated thereon. For example, the copper plating 57 is preferably between 0.00005 and 0.0001 inches and the tin plating is preferably between 0.00015 and 0.0002 inches thick. These coatings may be applied by electroplating these metals on the surface of the ungrooved strip. The plated strip is formed into the grooved strip 4' by first milling or otherwise forming the aforementioned groove 24 to a rough desired depth somewhat less than the desired depth throughout the length of one face of the strip. The milled groove 24 is than skived or otherwise machined to a precise depth to form a fuse link strip portion of precise reduced thickness.

The advancing strip 4' of fuse metal is first edge stamped as indicated at 68 to provide accurate width dimensions to the strip 4' and the blanks 4'' formed therein. The strip is also provided with notches 69 in the edges thereof at the dimensions 4''' subsequently to form edge tapers on the blade portions 8. Next, the interlock openings 26 are blanked in the strip. Following this, the advancing strip 4' of fuse metal is then blanked to form the terminal blade portions 8, the current-carrying extensions 14 thereof and the further extensions or tabs 18 thereof, and the fuse link portion 20 of fixed reduced thickness dimension. This blanking may be accomplished in one blanking operation as illustrated in FIG. 15 or in a plurality of, for example two, blanking operations as illustrated in FIG. 16. In the two-step blanking operation in FIG. 16 the strip is first blanked as indicated at 66 to form a portion of the current-carrying extensions 14 and a portion of the fuse link portion 20. Thereafter, the strip is blanked at 64 to complete the formation of the current carrying extensions 14 and the fuse link portion 20 of reduced thickness extending between the currentcarrying extensions 14. During this same blanking operation, the extensions or tabs 18 are formed. In the method illustrated in FIG. 15 where a single blanking operation is utilized, the blanking at 66 and 64 occurs simultaneously. In both of these blanking operations the transverse web 10' still remains between the terminal forming blade portions 8 of each blank. Because of the groove 24 extending throughout the length of the strip 4' of fuse metal, the transverse web 10' is also of reduced thickness having the fixed thickness dimension, but it has sufficient rigidity and strength to rigidify the plug-in fuse elements 4' during the processing thereof.

As shown in FIGS. 15 and 16, the housing 6 is inserted over the end blanks 4'' to receive the currentcarrying extensions 14 and the further extensions or tabs 18 thereof and the fuse forming link portion 20 within the housing and with the terminal forming blade portions 8 still interconnected by the transverse web 10' extending from the housing. The housing is then cold staked in the interlock openings 26 of the end blank 4'' as indicated in FIG. 6. Preferably, the placing of the housing 6 over the end blank 4'' and securing the housing to the end blank occurs after severing the end blank from the strip at the blank edge 4'''. In this method the severed end blank 4'' is securely held while the housing is being inserted thereover and being staked thereto. This then forms the substantially completed plug-in fuse assembly, but with the transverse web 10 still intact. The projections 52 which meet within the openings 26 as illustrated in FIG. 6 are then ultrasonically welded together to form a firm connection through the openings 26 between the sides 30*a*–32*a*. Thereafter, the transverse web 10' is blanked at 12 to provide the spaced apart terminal forming blade portions 8 as indicated in FIG. 1. Also thereafter, the ends of the terminal blade portions 8 may be coined as illustrated at 9 in FIG. 1 to form tapered ends for the terminal blade portions 8. In this way, the complete plug-in fuse assembly as illustrated in FIG. 1 may be provided which may have desired selected fuse ratings as described above.

As expressed above, the strip 4' of fuse metal may be plated, such as tin plated, along the portions of the strip forming the terminal blade portions 8—8, the current-carrying extensions 14—14 thereof, and the extensions or tabs 18 thereof to provide good electrical contact between the terminal blade portions 8—8 and the pressure clip terminals in a mounting panel in which they are received.

Before the blanking operations illustrated in FIGS. 15 and 16 are made, the strip 4' may be selectively printed at spaced apart intervals therealong in desired selected colors corresponding to desired selected fuse ratings of the plug-in fuse assemblies to be made. The positioning of the printing is such that when the plug-in fuse elements are made, the printing occurs at the current-carrying extensions 14 of the plug-in fuse element 4 and since the housing is transparent such color coding on the plug-in fuse element is visible through the transparent housing. This color coding may be in addition to the fuse rating printed on the top wall 38 of the housing 6.

While for purposes of illustration herein preferred plug-in fuse assembly constructions have been disclosed constituting important specific aspects of the invention, many variations may be made therein within the teachings of the broad aspects of the invention. For example, the broader aspects of the invention envision plug-in fuse assembly constructions like that shown in the drawings and described except that the terminals and currentcarrying extensions are made of a metal like aluminum or copper and the fuse link is a fuse metal part welded or otherwise anchored to the current-carrying extensions thereof.

We claim:

1. A high current plug-in fuse assembly comprising: a plug-in fuse element including a pair of laterally spaced generally parallel confronting terminal portions, the terminal portions having current-carrying extensions projecting longitudinally from the inner end portions thereof and which are interconnected by a fuse link made of fuse metal, said fuse link extending between said current-carrying extensions at points much closer to said terminal portions than to the outer ends of said current-carrying extensions, and an insulating body rigidly anchored between said current-carrying extensions and made of a material which has a relatively low melting temperature in comparison to the blowing temperature of the fuse link of said plug-in fuse element, said insulating body being substantially spaced from said fuse link portion of said plug-in fuse element.

2. The plug-in fuse assembly of claim 1 wherein said insulating body is anchored to said current-carrying extensions by portions of said insulating body deformed into anchoring apertures in said current-carrying extensions, said fuse link of said plug-in fuse element making connection with said current-carrying extensions at points thereof located on the terminal portion side of all of said apertures, whereby the cross-sectional area of the portions of said current-carrying extensions which carry current between said fuse link and terminal portions of said plug-in fuse element is not reduced by said apertures.

3. The plug-in fuse assembly of claim 1 wherein said insulating body forms an enclosure for said fuse link portion of said plug-in fuse element to prevent spewing of fuse metal outside thereof when the fuse blows.

4. The plug-in fuse assembly of claim 1 consisting solely of said insulating body and said plug-in fuse element made entirely of metal.

5. The plug-in fuse assembly of claim 1 consisting solely of said insulating body and said plug-in fuse element made entirely of metal.

6. A high current plug-in fuse assembly comprising: a plug-in fuse element including a one-piece plate-like body of fuse metal which body forms a pair of juxtaposed laterally spaced generally parallel terminal blade portions to be received by pressure clip terminals in a mounting panel, the terminal-forming blade portions having current-carrying extensions projecting longitudinally from the inner end portions thereof and which are interconnected by a fuse link portion of much smaller cross-sectional area than said terminal blade portions and the current-carrying extensions thereof, said fuse link portion extending between said current-carrying extensions at points much closer to said terminal blade portions than to the outer ends of said current-carrying extensions; and an insulating body rigidly anchored between said current-carrying extensions and made of a material which has a relatively low melting temperature in comparison to the blowing temperature of the fuse link portion of said plug-in fuse element, said insulating body being substantially spaced from said fuse link portion of said plug-in fuse element.

7. The plug-in fuse assembly of claim 6 wherein said insulating body is anchored to said current-carrying extensions by portions of said insulating body deformed into anchoring apertures in said current-carrying extensions, said fuse link portion of said plug-in fuse element making connection with said current-carrying extensions at points thereof located on the terminal portion side of all of said apertures, whereby the cross-sectional area of the portions of said current-carrying extensions which carry current between said fuse link and terminal portions of said plug-in fuse elements are not reduced by said apertures.

8. A plug-in fuse element comprising: a one-piece plate-like body of fuse metal which body comprises a pair of spaced confronting generally parallel terminal blade portions to be received by pressure clip terminals or the like, a pair of confronting currentcarrying extensions projecting longitudinally from the inner ends of the pair of terminal blade portions and a fuse link portion extending transversely between the confronting margins of said currentcarrying extensions, the width of said currentcarrying extensions being of the same order of magnitude as that of the terminal blade portions and the width of said fuse link portion being many times less than the width of said terminal blade portions and currentcarrying extensions thereof so that the cross-sectional area of said fuse link portion forms a resistance element which is heated by current flowing therethrough, and said fuse link portion have a repeatedly undulating configuration to provide a relatively large resistance for a given limited spacing between said current carrying extensions.

9. The plug-in fuse element of claim 8 wherein said repeatedly undulating fuse link portion is formed by the configuration which has end sections joining said currentcarrying extensions and projecting generally longitudinally of said currentcarrying extensions and each of said end sections joining a reversely extending intermediate section which also extends generally longitudinally of said currentcarrying extensions.

10. The plug-in fuse element of claim 8 wherein said fuse link portion is generally S-shaped.

11. The plug-in fuse element of claim 8 wherein said fuse link portion extends from said current-carrying extensions from points thereof substantially closer to the outer end portions than the inner end portions thereof at their points of connection to the terminal blade portions.

12. The plug-in fuse element of claim 9 wherein said fuse link portion extends from said current-carrying extensions at points remote from the end of said current-carrying extensions adjacent to said terminal blade portions.

13. A plug-in fuse element comprising: a pair of spaced confronting generally parallel terminals, a pair of confronting current-carrying extensions projecting longitudinally from the inner ends of the pair of terminal portions and a fuse link made of fuse metal extending transversely between the confronting margins of said current-carrying extensions, said fuse link having a configuration undulating in a plane generally coplanar or parallel to a plane containing said terminals and current-carrying extensions, the major portion of the length of such undulating fuse link being parallel to the length of the current-carrying extensions to provide a relatively large resistance for a given limited spacing between said current-carrying extensions.

14. The plug-in fuse element of claim 13 wherein at least one end of the fuse link joins a said current-carrying extension near the end thereof remote from the end adjacent to said terminals.

15. The plug-in fuse element of claim 14 wherein both ends of the fuse link join said current-carrying extensions near the end thereof most remote from the end adjacent to said terminals.

16. The plug-in fuse element of claim 13 wherein said undulating fuse link is a repeatedly undulating configuration having end sections joining said current-carrying extensions and projecting generally longitudinally of said current-carrying extensions and each of said end sections joining a sharply reversely extending intermediate section which also extends generally longitudinal of said current-carrying extensions.

17. The plug-in fuse element of claim 13 wherein said fuse link is S-shaped.

* * * * *